US005237843A

United States Patent [19]

Charbonneau et al.

[11] Patent Number: 5,237,843

[45] Date of Patent: Aug. 24, 1993

[54] DEVICE FOR RETAINING A KEYLOCK KEY

[75] Inventors: Michel Charbonneau, Eybens, France; Luis Xaux; Josep Salvador, both of Barcelone, Spain

[73] Assignee: Merlin Gerin, France

[21] Appl. No.: 948,491

[22] Filed: Sep. 22, 1992

[30] Foreign Application Priority Data

Oct. 4, 1991 [FR] France ..... 91 12343

[51] Int. Cl.[5] ..... E05B 15/06

[52] U.S. Cl. ..... 70/346; 70/370; 70/451; 292/251

[58] Field of Search ..... 70/451, 346, 345, 387, 70/404, 449, 370, 453, 454, 375; 292/251, DIG. 38, 336.3

[56] References Cited

U.S. PATENT DOCUMENTS

| | | | |
|---|---|---|---|
| 1,568,434 | 1/1926 | Winterson | 292/251 |
| 1,580,611 | 4/1926 | Kirkpatrick | 70/345 |
| 1,639,661 | 8/1927 | Newcomb | 292/251 |
| 2,745,275 | 5/1956 | Jacobi | 70/370 |
| 3,251,205 | 5/1966 | Kerr | 70/404 |
| 3,907,348 | 9/1975 | Bates et al. . | |
| 4,139,998 | 2/1979 | Jeavons et al. | 70/370 |

FOREIGN PATENT DOCUMENTS

| | | |
|---|---|---|
| 0175211 | 3/1986 | European Pat. Off. . |
| 2818479 | 12/1978 | Fed. Rep. of Germany . |
| 2172648 | 9/1986 | United Kingdom . |

*Primary Examiner*—Peter M. Cuomo
*Assistant Examiner*—Darnell M. Boucher
*Attorney, Agent, or Firm*—Parkhurst, Wendel & Rossi

[57] ABSTRACT

A keylock system comprising a lock and a key for opening and closing the lock, the key having an outer radial retaining stub protruding radially outward, the lock including a base plate for attachment to a surface of an enclosure, a cylinder rotatably mounted within the base plate, the cylinder having a first end adapted to engage the key, and a second end protruding from the base plate, the cylinder being rotatable between open and closed positions, and retaining sleeve threaded onto the cylinder. The retaining sleeve comprises a plurality of retaining fingers engaged with the cylinder to a low rotation thereof, an immobilizing finger for engagement with the base plate to prevent rotation of the retaining sleeve, and a top annular surface defining an opening having a reduced diameter which allows passage of the key therethrough. The top annular surface has a slot to accommodate the outer radial retaining stub of the key, the slot of the retaining sleeve being arranged with respect to the cylinder such that the key is retained within the lock by abutting contact between the outer radial retaining stub and the top annular surface in the open position, and such that the key may be disengaged from the lock in the closed position.

6 Claims, 2 Drawing Sheets

DEVICE FOR RETAINING A KEYLOCK KEY

BACKGROUND OF THE INVENTION

The invention relates to a keylock with a removable rotating key, notably for an electrical switch gear enclosure or cabinet, comprising a base-plate for fixing onto an enclosure wall the base plate and defining a cylindrical housing, a rotatable cylinder mounted with in the housing and having one end protruding out from the base-plate adjacent the wall and cooperating with a locking component and a second end which is prismatic, and a key of conjugate proximatic shape to that of the second end to cooperate by fitting onto the latter and driving it in rotation from a closed position of the keylock to an open position and vice-versa.

A keylock of the kind mentioned above requires a key for opening and closing of the enclosure, while not being a safety lock, which is considerably more complicated. These keylocks, hereinafter called square drive locks enable the locking system such as a simple cam or a basquil boz, to be satisfactorily controlled, but they do not allow the door equipped with this lock easy to open. A traction exerted on the key to open the door pulls the key out of the lock, and the door therefore has to be equipped with a handle or a drip system, to be able to open the door easily. The handles constitute particularly cumbersome non-flush parts, whereas the gripping locations are necessarily small in size and sometimes difficult to access.

The object of the present invention is to provide a keylock, whose key achieves opening and closing by a simple rotation and enables a traction effort to be exerted on the door to open the latter.

SUMMARY OF THE INVENTION

The keylock according to the invention comprises a retaining sleeve threaded onto said cylinder and having protrusions which cooperate with conjugate parts to axially position the sleeve with respect to the cylinder while allowing rotation of the cylinder. The sleeve is rotatably immobilized and the sleeve presents at one end a flange folded inwards to define a reduced input section, matching that of the key. The flange comprises a slot for providing passage of a retaining stub protruding from the external circumference of the key, the slot being positioned in relation to the cylinder in such a way that in thee open position of the keylock, theist is held captive behind the flange and prevents thee from being removed, whereas in the closed position the stub is in alignment with the slot to enable the key to be inserted and removed.

In the closed position of the door and keylock, the key can be removed and there are no non-flush parts remaining on the door. Opening is performed in the usual manner, by inserting and turning the key which is retained in the keylock and enables the door to be pivoted by pulling on the key.

The keylock advantageously uses standard components, to which there has been added a retaining sleeve threaded onto the cylinder and secured axially on the cylinder. Fingers which extend along the generating line of the sleeve secure the sleeve to the cylinder, and present at their end a nose engaged in a circular groove of the cylinder. Fixing of the sleeve on the cylinder is achieved by clipping, whereas after the cylinder/sleeve assembly has been inserted in the base-late housing, the retaining fingers are immobilized by the internal circumference of the housing, preventing them from coming unclipped. The sleeve also bears immobilizing fingers similar to the clipping fingers, but of greater length, which when the cylinder/sleeve assembly is fitted in the housing, engage in grooves arranged in this housing to prevent rotation of the sleeve. The base-plate is generally fixed to an external part of the door, whereas the cylinder passes through an orifice arranged in the door, and bears, on an internal part, the locking system, for example a simple cam, fixed by a screw which at the same time secures the cylinder in the base-plate housing. The locking system can naturally be of a different type, notably with a basquil box. When the keylock is fitted, care merely has to be taken to position the stubs on the key in alignment with the slots in the sleeve, when the locking cam and cylinder are in the closed position. Error preventers can make assembly easier. The key advantageously bears two diametrically opposed stubs, and the gripping end is arranged as a handle, which allows the key to be pulled to open the door.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DESCRIPTION OF THE PREFERRED EMBODIMENT

Figure 1:
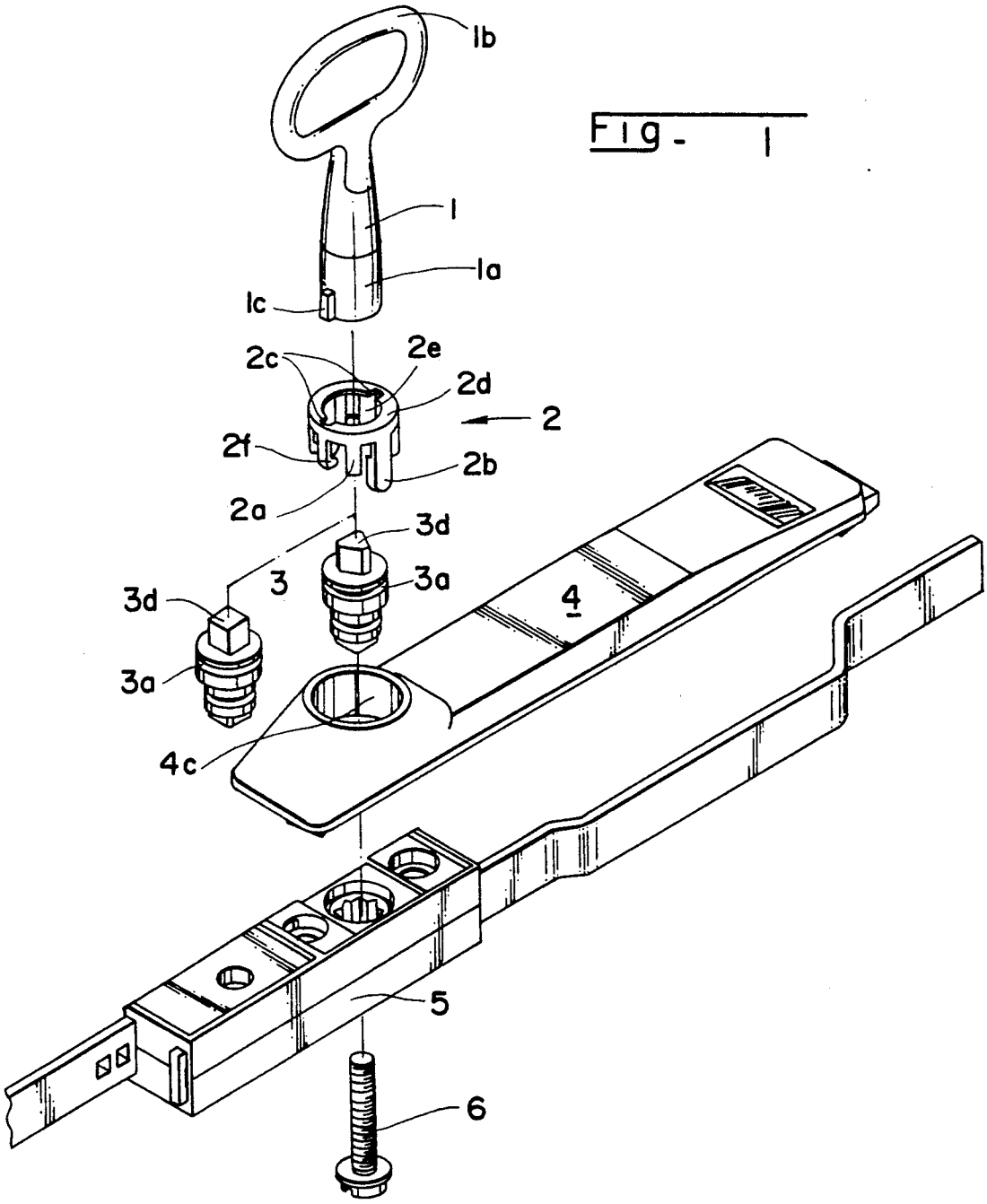
FIG. 1 is an exploded schematic view of a keylock according to the invention.
Figure 3:
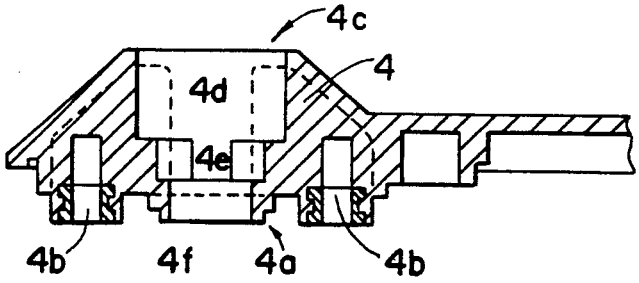
FIG. 3 is a cross section along the line III—III of FIG. 2.

In the drawings, a base-late 4 represents on one of its faces 4*a*, threaded blind orifices 4*b* receiving screws for fixing to the external face of the door of an electrical switch gear enclosure (not shown). Perpendicular to the face 4*a* there extends a cylindrical housing 4*c* with three staggered sections 4*c*, 4*e* and 4*f*, the smallest section 4*f* being the same side as a face 4*a*, flush against the surface of the door. A cylinder 3 of conjugate shape to that of the housing 4*c* is fitted into the latter end 3*c*, protruding from the face 4*a* of the base-plate 4. The opposite end 3*d* internal to the section 4*d* of the housing 4*c* is arranged as a prismatic end, either as a triangular end or as a square end as represented in FIG. 1. At the base of the end 3*d* there is provided a grooved collar 3*a*, whose section is smaller than that of the part 4*d* of the housing 4*c* to arranged an annular gap for a retaining sleeve 2. The sleeve 2 of general cylindrical shape presents at one of its ends a flange 2*d* folded inwards and confining a cylindrical orifice 2*e*. Two diametrically opposed rectangular slots 2*c* are arranged in the internal edge of the flange 2*d*. In the part of the sleeve 2 opposite from the flange 2*d*, retaining fingers 2*a* extend really and are distributed along the circumference of he sleeve 2, and whose free end is shaped as a retaining lip. The length of the retaining fingers 2*a* corresponds to the height of the large section 4*d* of the housing 4*c*, whereas two fingers are of greater length to form immobilizing fingers 2*b*.

Figure 4:
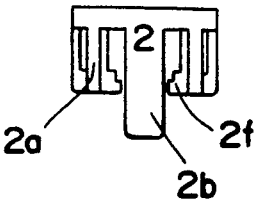
FIG. 4 is an elevational view of the sleeve according to FIG. 1.
Figure 2:
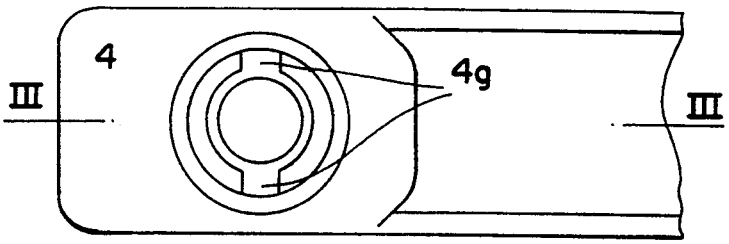
FIG. 2 is a plan view of the base-plate according to FIG. 1.
Figure 5:
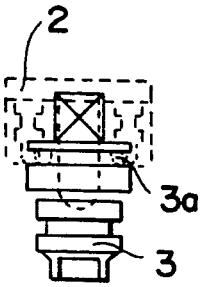
FIG. 5 is an elevational view of the cylinder according to FIG. 1, the sleeve fitted on the cylinder being represented by the dashed line.
Figure 7:
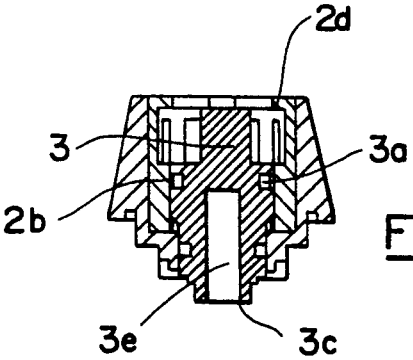
FIG. 7 is a cross section along he line VII—VII of FIG. 6.
Figure 6:
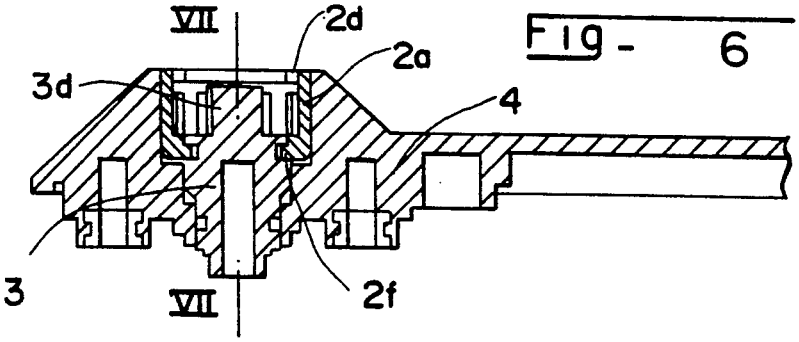
FIG. 6 is a similar view to that of FIG. 3, showing the cylinder/sleeve assembly fitted on the base-plate.

As represented in FIGS. 4 nd 5, the sleeve 2 can be clipped onto the cylinder 3, the retaining clips 2*f* extending into the groove 3*a*. In the position clipped onto the cylinder 3, the diameter of the sleeve 2 corresponds to that of the large section 4*c*, and the cylinder 3 and sleeve 2 assembly can be inserted in the housing 4*c*. The immobilizing fingers 2*b* engage in two grooves 4*c*, arranged in the intermediate section 4*e* of the housing 4*c*. On the face 3*c* there is provided a threaded hole 3*e* designed to receive a fixing screw 6 of a locking component, for example a basquil box 5, generally located inside the enclosure and applied against the wall of the door. The basquil box 5 is secured to the base-plate 4, for example by the screws which screw into the orifices 4*b*, and it can be seen that the fixing screw 6 holds the cylinder 3 securely in the housing 4*c*. A key 1 comprises at one end a grip in the form of a handle 1*b*, and at the opposite end a cylindrical section 1*a* with a diameter corresponding to the orifice 2*e* confined by the flange 2*c*. The key 1 presents two diametrically opposed stubs 1*c* of conjugate shape to the slots 2*c*. The cylindrical section 1*a* is hollowed out in the center to form a housing of conjugate shape to the end 3*d*, in which the latter is housed when the key 1 is inserted in the sleeve 2. For the key 1 to be able to be inserted, the stubs 1*c* must be aligned with the slots 2*c* and the end 3*d* be in a position enabling the key 1 to be fitted onto this end 3*d*. According to the invention, this position corresponds to the closed position of the locking system 5. In the closed position of the keylock, the key 1 can be fitted onto the end 3*d*, and the stubs 1*c* come to the rear of the flange 2*c*, allowing the key 1 to rotate to open the lock. In this open position, the stubs 1*c* are retained by the flange 2*d* and the key is retained and cannot be removed. It is however possible to exert a traction on the key 1 which is transmitted to the door to open it. In the open position of the keylock, the key is held captive, which is not a drawback. Closing is achieved by a reverse operation in which the door is closed and the key 1 rotated moving the stubs 1*c* back into line with the slots 2*c*. In this closed position of the keylock, the key can be removed, the protrusion of the lock then being extremely slight. The sleeve 2 is rotatably immobilized by the fingers 2*b*, to maintain the position of the stubs 2*c*, but this immobilization does not hamper the rotation movement of the cylinder 3, due to the groove 3*a*, in which the retaining clips 2*f* slide. Any risk of the sleeve 2 coming unclipped due to the traction effort exerted by the key 1 is excluded, by the binding of the immobilizing fingers 2*a*, by the internal wall of the housing 4*c*.

The retaining sleeve 2 is an extremely simple part, which is able to be utilized with other types of key locks. The invention is naturally in no way limited to the embodiment described above, but extends to any alternative embodiment remaining within the scope of equivalence. For example, the retaining fingers may be clipped into a groove arranged in the housing 4*c*, or the sleeve 2 may be secured to the base-plate 4 by any suitable means.

We claim:

1. A keylock system comprising a lock and a key for opening and closing the lock, said key comprising an outer radial retaining stub protruding radially outward, the lock comprising:

a base plate for attachment to a surface of an enclosure;

a cylinder rotatably mounted within said base plate, said cylinder having a first end adapted to engage said key, and a second end protruding from said base plate, said cylinder being rotatable between open and closed positions; and a retaining sleeve threaded onto said cylinder, said retaining sleeve comprising a plurality of retaining fingers engaged with said cylinder to allow rotation of said cylinder, an immobilizing finger engaged with the base plate to prevent rotation of the retaining sleeve, and a top annular surface defining an opening having a reduced diameter which allows passage of said key therethrough, said top annular surface having a slot to accommodate the outer radial retaining stub of the key, said slot of the retaining sleeve being arranged with respect to the cylinder such that the key is retained within the lock by abutting contact between the outer radial retaining stub and the top annular surface in the open position, and such that the key may be disengaged from the lock in the closed position wherein the outer radial retaining stub and the slot are aligned.

2. The keylock system of claim 1, wherein the retaining fingers extend along the longitudinal axial direction of the cylinder, each of said retaining fingers comprising a retaining clip which extends into an outer circular groove in said cylinder.

3. The keylock system of claim 1, wherein the immobilizing finger engages a groove in the housing.

4. The keylock system of claim 1, wherein outer side surfaces of the first end of the cylinder form a polygonal shape, and wherein said key has a cavity defined by inner side surfaces which form a complementary polygonal shape.

5. The keylock system of claim 1, wherein said cylinder comprises a threaded internal orifice which is open at the second end of the cylinder, said keylock system further comprising a screw threaded into said threaded internal orifice.

6. The keylock system of claim 5, further comprising a locking component attached to the cylinder by said screw.

* * * * *